United States Patent [19]

Bellezza

[11] Patent Number: 4,555,991

[45] Date of Patent: Dec. 3, 1985

[54] GUARD-HOUSE OF IMPROVED TYPE

[75] Inventor: Gianfranco Bellezza, Turin, Italy

[73] Assignee: C.P.M. S.p.A. Impianti Industriali, Turin, Italy

[21] Appl. No.: 568,366

[22] Filed: Jan. 5, 1984

[30] Foreign Application Priority Data

Jan. 11, 1983 [IT] Italy ..... 52826/83[U]

[51] Int. Cl.[4] ..... E04H 1/12; E04H 3/08

[52] U.S. Cl. ..... 109/9; 52/106; 109/58.5

[58] Field of Search ..... 52/106, 28, 29, 65; 109/9, 58.5

[56] References Cited

U.S. PATENT DOCUMENTS

| | | | |
|---|---|---|---|
| 516,450 | 3/1894 | Salfield et al. | 52/106 |
| 606,451 | 5/1898 | Miller | 109/58.5 |
| 1,347,652 | 7/1920 | Olson | 109/58.5 X |
| 1,374,770 | 4/1921 | Simmons | 109/9 |
| 1,379,610 | 5/1921 | Bartholomew | 52/106 |
| 1,547,841 | 7/1925 | Stevens | 109/9 |
| 1,687,280 | 10/1928 | Brockett | 52/106 |
| 1,827,347 | 10/1931 | Barota | 109/9 |
| 2,043,207 | 6/1936 | Bayley et al. | 52/106 |
| 2,046,726 | 7/1936 | Cooper | 109/9 |
| 2,137,439 | 11/1938 | Bayley | 52/106 |

FOREIGN PATENT DOCUMENTS

| | | | |
|---|---|---|---|
| 144500 | 1/1936 | Fed. Rep. of Germany | 109/9 |

*Primary Examiner*—Alfred C. Perham
*Attorney, Agent, or Firm*—Albert L. Jeffers

[57] ABSTRACT

The armoured guard-house allows one or more guards to be protected and is provided with an armoured lateral envelope provided with at least one glazed observation area or window protected by bullet-proof glass, a base and an upper closure canopy. The window is composed of an opaque reinforced frame of grid supports delimiting a plurality of window openings of relatively small dimensions, closed by means of transparent panes made of a bullet-proof glass and each having a reflective surface facing outwardly of the guard-house in such a way that an external observer cannot see through the glazed area. The guard-house is made in such a way as to resist the impact of armoured bullets fired from military rifles of the FAL-type.

11 Claims, 5 Drawing Figures

GUARD-HOUSE OF IMPROVED TYPE

BACKGROUND OF THE INVENTION

The present invention relates to an armoured guard-house of improved type for protecting one or more sentries.

It is known that because of the increase in terrorist phenomena and common organised crime, guards put in charge of the surveillance of particularly rewarding objectives such as barracks, prisons, important business premises and military concerns must be protected from surprise attack by housing them in armoured guard-houses provided with wide observation windows protected by bullet-proof glass, in such a way as to allow the guards to survey the environment surrounding the guard-house from the interior thereof without being directly exposed to the fire of possible assailants. Known armoured guard-houses have a parallelepiped form with at least one armoured lateral envelope for the protection of the guards, constituted by four walls perpendicular to one another and made of steel and/or masonry and each provided with a wide glazed observation area constituted by a single opening closed by bullet-proof glass of suitable thickness.

The guard-houses described are not free from disadvantages. In the first place the bullet-proof glass which protects the glazed observation areas becomes opaque when struck by a bullet, even if it is not perforated by such bullet; it is therefore only necessary to fire a few projectiles against the glass to render the guards within the guard-house effectively blind and prevent their retaliation through the firing slits with which armoured guard-houses are normally provided. In the second place the flat quadrangular form of known guard-houses offers a wide impact surface to bullets, perpendicular to the trajectory of the bullets themselves thereby facilitating the perforation of the window glass and the armour plating of the guard-house, whilst the transparency of the glazed observation area allows the assailants to take aim through these at the guards housed within the guard-house making injuries certain in the event of perforation of the bullet-proof glass. Since assailants tend these days to utilise FAL-type military rifles provided with armour piercing ammunition the result is that the windows of known guard-houses can easily become perforated thereby nullifying the protection offered to the guards by the guard-house itself.

SUMMARY OF THE INVENTION

The object of the present invention is to provide an armoured guard-house for protecting guards, which will be free from the described disadvantages, and in particular capable of offering a satisfactory protection in the event of attack conducted with FAL-type military rifles with armour piercing ammunition.

A further object of the present invention is to guarantee that guards protected within the interior of the guard-house will have sufficient visibility to allow them to return fire even in the event that the glazed observation areas are struck in one or more places, and at the same time to prevent assailants from holding the guards themselves in their sights.

The said objects are achieved by the present invention in that it relates to an armoured guard-house for housing guards, of the type comprising a base, an armoured lateral envelope provided with at least one glazed observation area protected by bullet-proof glass, and an upper closure canopy, characterised by the fact that the said glazed observation area includes, in combination, an opaque armoured support frame in the form of a grid sub-divided into a plurality of compartments each delimiting a window of relatively small dimensions with respect to those of the glazed area as a whole, and a plurality of panes made of bullet-proof glass which can each be lodged in one of the said compartments of the said frame to close the associated said window, each said pane having a reflecting surface facing outwardly of the guard-house in such a way that the said guards housed within the said guard-house can see the surrounding environment through the said window whilst an external observer outside the guard-house cannot see through the said window.

BRIEF DESCRIPTION OF THE DRAWINGS

For a better understanding of the present invention there will now be given a non limitative description of two embodiments thereof, with reference to the attached drawings, in which.

DETAILED DESCRIPTION OF THE INVENTION

Figure 1:
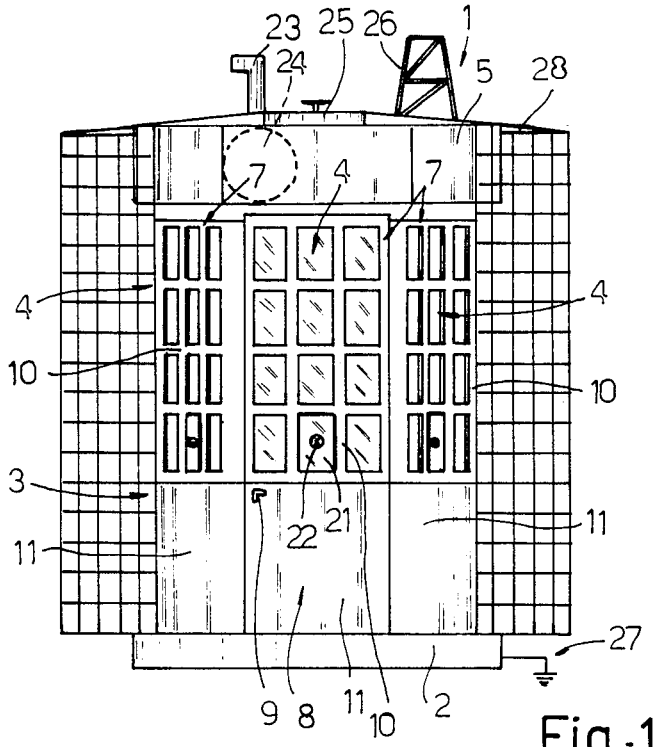
FIGS. 1 and 2 illustrate, respectively, a side view and plan view of an armoured guard-house formed according to the principles of the present invention.
Figure 2:
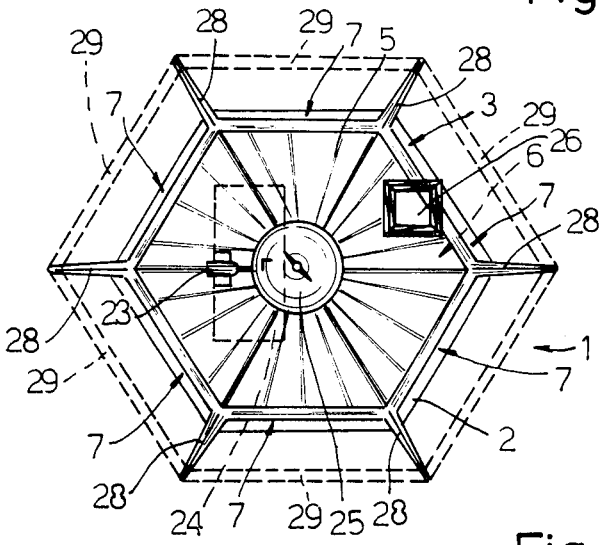
Figure 4:
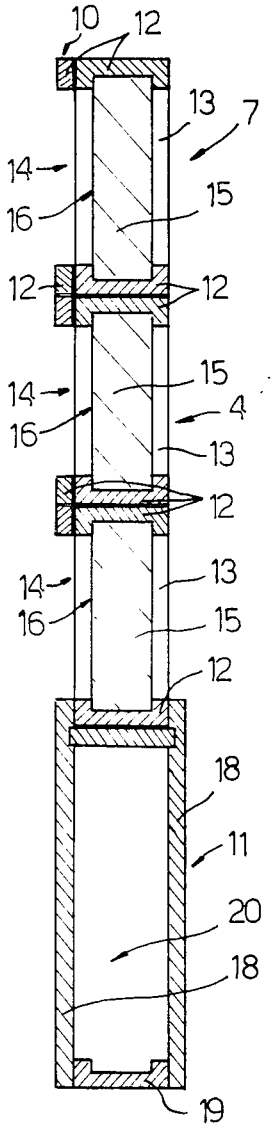
FIG. 4 is a section taken on a line IV—IV of FIG. 3.
Figure 3:
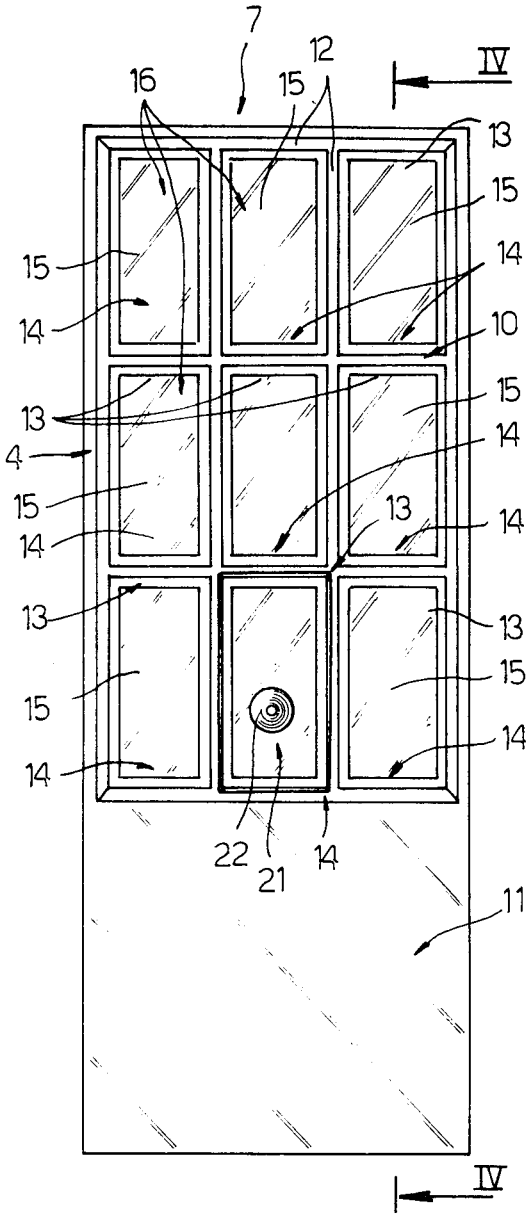
FIG. 3 is a side view on an enlarged scale of a detail of the guard-house of FIGS. 1 and 2.

With reference to FIGS. 1 and 2 an armoured guard-house for protecting guards is generally indicated with the reference numeral 1, and is able to house within it one or more guards put in charge of the surveillance of civil and military objectives, to allow these to observe the environment surrounding the guard-house 1 whilst remaining sheltered from armed attack from possible assailants, in such a way as to be able to react to the attack and/or immediately raise the alarm. The guard-house 1 comprises a base 2 which can be fixed rigidly to the ground or to a floor by means of suitable foundations, an armoured lateral envelope 3 provided with at least one glazed observation area 4 protected by bullet-proof glass, and an upper closure canopy 5 which serves as the roof of the guard-house 1 and which is fixed rigidly to the lateral envelope 3 which is, in turn, rigidly fixed to the base 2. Preferably the canopy 5 and the base 2 are also at least partly armoured in a similar manner to the lateral envelope 3, for example by using armour plates of chrome-silicon-molybdenum steel or any other suitable material (for example composite panels of carbon fibres and/or kevlar). According to the invention the guard-house 1 is of substantially prismatic form, preferably with a base of hexagonal plan; in particular the armoured lateral envelope 3 and the canopy 5 delimit within their interior a safe chamber 6 for the said guards, which has (FIG. 2) a polygonal plan form and is in any case provided with a number of sides greater than four, in that the envelope 3 includes at least five walls 7 (in the illustrated example the envelope 3 includes six walls 7) which are substantially flat and disposed at an angle to one another and each provided with a glazed area 4; one of the walls 7 is provided with an entrance door 8 provided with a burglar-proof lock 9 which allows access to the protective chamber 6. With reference also to FIGS. 3 and 4, which illustrate a wall 7 on an enlarged scale, each glazed area 4 occupies at least about half of the surface of the associated wall 7 in such a way as to allow the guards protected within the chamber 6 a wide view; each wall 7 includes an opaque upper armoured support frame 10 formed as a grid, and a lower armoured panel 11 rigidly connected to the frame 10. The frame 10 is made of armour plate steel, preferably chrome-silicon-molybdenum steel, and is obtained by casting in a single piece, or else, preferably, by means of joining together a plurality of sections 12, and is sub-divided into a plurality of compartments 13 each delimiting a respective window 14 of relatively small dimensions with respect to those of the glazed area 4, and of any form, preferably rectangular. The windows 14 delimit the same number of portions of the glazed area 4, which as well as the frame 10, comprises a plurality of window panes 15 made of bullet-proof glass of any known composition, which can be lodged each in one compartment 13 of the frame 10 to close the associated window 14. The panes 15 are transparent, but each have a reflecting surface 16 facing outwardly of the guard-house 1; the surfaces 16 are made reflective without altering the transparency of the remainder of the window pane 15 by means of any known method, for example by depositing on the surface 16 a reflecting layer of the type used for lenses of reflecting sunglasses, or else by applying onto the surface opposite to the surface 16, a skin of synthetic photo-absorbent material of the type utilised for motor vehicle windscreens. In any case the result is that each window pane 15 is transparent, but is provided with an external reflecting surface 16 so that the glazed area 4 is transparent only if viewed from the interior of the guard-house 1; therefore the guards protected in the chamber 6 can see the environment surrounding the guard-house 1 through the glazed area 4, whilst an observer outside the guard-house 1 cannot see through the glazed area 4 in that the light is reflected therefrom towards the outside. In this way a possible assailant cannot take aim at the guard or guards within the interior of the guard-house 1 in that they are not visible from the outside.

The window pane 15 must have a thickness sufficient to resist the impact of an armour piercing bullet fired from a weapon such as a FAL-type military rifle, and preferably has dimensions such as to be inscribed within a circle of diameter equal to about 250 mm; since, as is known, the rules for type-approval of bullet-proof glass prescribe that these must resist the impact of six successively fired bullets, the first at the centre of a circumference of diameter equal to 250 mm, and the subsequent five in correspondence with the perimeter of the said circumference, this dimensional limitation makes it possible that each window 14 can be struck at most by a single projectile. Experimental tests have demonstrated that by adopting window panes 15 made of bullet-proof glass of a thickness equal to 56 mm and of dimensions which can be inscribed within a circumference of a diameter of 250 mm, the glazed area 4 is substantially imperforable even by armour piercing bullets, since these are not fired from a distance so close as to allow the marksmen to fire groups of rounds of reduced scattering such as to cause several successive bullets to be targeted onto the same window pane 14.

Each armoured panel 11 includes two steel plates 18, preferably of chrome-silicon-molybdenum steel, one mounted in front of the other in facing positions, and in any case of a thickness less than that of the window panes 15, and fixed at the top to the lower edge of the frame 10; the plates 18 are spaced by a predetermined distance in that they are fixed onto the opposite faces of a perimetral frame 19, also of steel, in such a way as to create between them an interspace 20 of predetermined depth; such interspace 20 must remain empty, or, at most, be filled with an insulating material of low mechanical resistance, for example polystyrene, whilst the distance between the facing and spaced plates 18 must be in all cases greater than the length of the longest armour piercing bullet which can be fired from a FAL-type rifle. In this way a light, economical and effective armouring of the panel 11 is obtained in that an armour piercing bullet fired against it can perforate the outer plate 18 of the guard-house 1 with relative ease, but after the impact it only passes into the interspace 20, in which because of the lack of guidance due the absence of compact material to perforate, and because of the loss of kinetic energy upon impact with the outer plate 18, which upsets and/or stops the rotation of the bullet about its own axis, the bullet itself deviates from its proper trajectory and strikes the second plate 18 with a very low angle of impact, insufficient to allow perforation thereof. Experimental tests performed with bullets of NATO calibre $7.62 \times 23$ have demonstrated that the second plate 18 is just dented by the bullets, which stop in the interspace 20 without penetrating the chamber 6.

To allow the guards protected within the guard-house 1 to return fire, one of the windows 14 of each glazed area 4 is closed, instead of with a window pane 15, with a steel plate 21 preferably made by casting and mounted within the corresponding compartment 13 of the frame 10, provided with a firing opening 22, for example of known type used on armoured vehicles (VCI) comprising an insertion slide for a firearm and a protection plate preferably one which is automatically released, to allow the guards to make use of firearms from within the guard-house 1 through the said slides of the firing opening 22. The ventilation of the chamber 6 and the air conditioning of the guard-house 1 are ensured by at least one air inlet 23 preferably situated at the top of the canopy 5 and connected to an air conditioning device 24 housed within the canopy 5 itself; this latter is preferably provided with an inspection manhole closed by an armoured door 25 which can be locked from inside the chamber 6, and carries a support element 26 constituted by a lattice of suitable length for mounting possible accessories such as light or infra-red reflectors. The canopy 5 is further provided with suitable insulators and conductors connected to an earthing element 27 in such a way as to form a Faraday cage which can protect the chamber 6 from lightning and electrical discharge. Finally, the armoured guard-house 1 includes a series of radial support arms 28 which can support, at a predetermined distance from the glazed areas 4 and in front of these, respective anti-grenade nets 29 operable to make any possible grenades fired against the guard-house 1 explode before they strike the guard-house itself; in this way the guard-house 1 is able to resist even an attack conducted with anti-tank weapons in that any possible grenades projected against it explode, destroying the nets 29 at a distance such as not to perforate the walls 7 and thus allow the guards within the chamber 6 to react and give the alarm.

Figure 5:
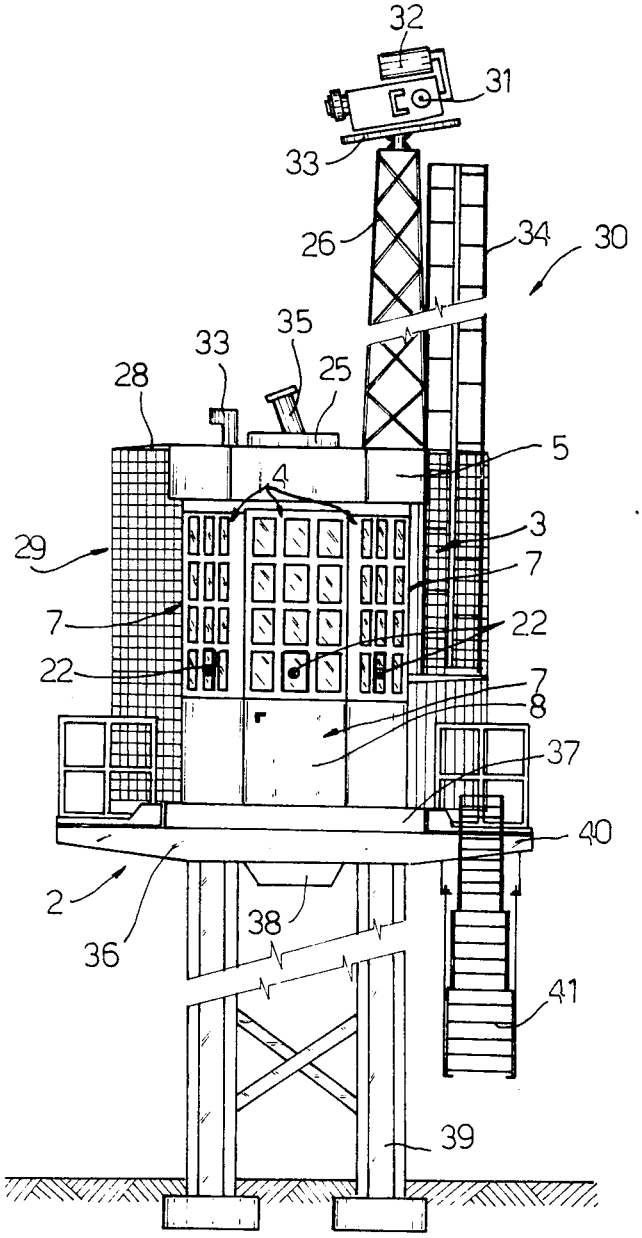
FIG. 5 illustrates a variant of the armoured guard-house of FIGS. 1 and 2.

FIG. 5 illustrates a variant 30 of the guard-house 1 of FIG. 1.

The same or similar details to those already described are indicated with the same reference numerals. The guard-house 30 is entirely similar to the guard-house 1 of FIG. 1 and is provided with anti-grenade nets 29 held by arms 28 and a pylon 26 provided with a television camera 31 and a light 32 which can be adjusted over a wide range (zoomable); the television camera 31 and light 32 are supported on a movable platform 33 and the pylon 26 is provided with an inspection ladder 34; the port hole 25 of the guard-house 30 of FIG. 5 is preferably provided with a mortar 35 for firing smoke generating devices and/or tear gas canisters and allows the inspection of the platform 33 which can possibly be provided with a control for lowering it towards the canopy 5.

As distinct from the guard-house 1 of FIG. 1, the guard-house 30 of FIG. 5 is provided with a base 2 including a foundation element 36 which can be anchored to the ground, and a support element 37 rotatably mounted like a turntable on the element 36 and rigidly connected to the lateral envelope 3 which is supported thereby. The guard-house 30 further includes means for producing rotation of the support element 37 and consequently of the lateral envelope 3 rigidly connected to it, about a substantially vertical axis of symmetry of the guard-house 30; such mean preferably include a motor, not illustrated, housed within the guard-house 30 or within an armoured gondola 38 supported from the element 36, and this latter is provided with a supporting framework 39 for holding the guard-house 30 in position raised above ground level in such as way as to increase the field of observation of the guards protected within the interior thereof. Preferably the element 36 is further provided with a platform 40 having a retractable access ladder 41. The possibility of making the lateral envelope 30 rotate in the event of an armed attack allows the guards protected within the chamber 6 to take a glazed area 4 already struck by hostile fire coming from a given direction out of the line of fire and substitute for it the immediately adjacent glazed area 4 which is still intact, which allows the maximum visibility for the guards to return fire; moreover by making the envelope 3 rotate permanently in the event of attack, the bullets fired by possible assailants strike surfaces in movement with the result that they become deflected thereby or else strike them at an angle of impact insufficient to permit perforation of the walls 7.

From what has been described the advantages of the present invention will be apparent. It allows armoured guard-houses to be provided which offer a satisfactory protection to the guards housed within them both in the case of attack with light arms and in the case of attack with military weapons (FAL) or heavy weapons such as granade launchers, and provides glazed observation areas which permit visbility to be maintained sufficient for the guards to return fire even after having been struck by numerous projectiles in that only those window panes 15 actually struck become opaque, whilst the intact window panes 15 of the same glazed area 4 remain transparent. Finally, since, in accordance with the invention, the glazed areas are reflecting, they do not allow assailants to take aim at guards protected within the guard-house thereby increasing the probability of survival of these latter even if the walls of the guard-house are perforated by several projectiles.

From what has been described, finally it is clear that variants and modifications can be introduced to the guard-house of the present invention without departing from the scope of the invention itself. In particular the guard-house 1 (or 30) can be made air tight and provided with suitable NBC filters in such a way as to safeguard the guards protected within it even from possible gas attacks.

I claim:

1. An armoured guard-house (1,30) for protecting guards, of the type comprising a base (2), a lateral armoured envelope (3) provided with at least one glazed observation area (4) protected by bullet-proof glass, and an upper closure canopy (5) characterised by the fact that the said glazed area (4) includes, in combination, an opaque armoured supporting framework (10) formed as a grid and sub-divided into a plurality of compartments (13) each delimiting a window (14) of relatively small dimensions with respect to those of the said glazed area (4), and a plurality of window panes (15) made of bullet-proof glass and each of which can be lodged in one of the said compartments (13) of the said framework (10) for closing the associated said window (14), each said window pane (15) having a reflecting surface (16) facing outwardly of the guard-house (1) in such a way that the guards housed within the interior of the said guard-house (1) can see the surrounding environment through the said glazed area (4) whilst an observer outside the said guard-house (1) cannot see through the said glazed area (4).

2. An armoured guard-house (1,30) according to claim 1, characterised by the fact that the said armoured lateral envelope (3) and the same canopy (5) together delimit within them a protective chamber (6) having a polygonal plan form for the said guards, the same lateral envelope (3) including at least five substantially flat walls (7) disposed at an angle to one another and each provided with a said glazed area (4), one of the said walls (7) being provided with an entrance door (8) for allowing entrance to the said protective chamber (6).

3. An armoured guard-house (1,30) according to claim 2, characterised by the fact that the said glazed area (4) occupies at least about half of the surface area of each said wall (7), these latter being formed at the top by the said armoured framework (10) for supporting the said window panes (15), and at the bottom by an armoured panel (11) rigidly connected to the framework (10).

4. An armoured guard-house (1,30) according to claim 3, characterised by the fact that the said armoured panel (11) includes two steel plates (18) mounted one in front of the other in spaced and facing positions, in such a way as to create between them an interspace (20) of predetermined depth, the distance between the said spaced and facing plates (18) being greater than the maximum length of an armour piercing bullet which can be discharged by a military rifle of the FAL type.

5. An armoured guard-house (1,30) according to claim 3, characterised by the fact that the said framework (10) and the said panel (11) are made from a chrome-silicon-molybdenum armour steel.

6. An armoured guard-house (1,30) according to claim 1, characterised by the fact that the said window panes (15) have a thickness sufficient to resist the impact of an armour piercing bullet discharged from a military weapon of the FAL type, and have dimensions such that they can be inscribed within a circle of diameter equal to 250 mm.

7. An armoured guard-house (1,30) according to claim 1, characterised by the fact that one of the said windows (14) is closed by a cast steel plate (21) mounted within the corresponding compartment (13) of the said framework (10) and provided with a firing opening (22) including an insertion slide and a protection plate which allow the guards to make use of firearms from within the said guard-house (11).

8. An armoured guard-house (30) according to claim 1, characterised by the fact that the said base (2) includes a foundation element (36) which can be anchored to the ground, and a support element (37) rotatably mounted as a turntable on the said foundation element (36) and rigidly connected to the said lateral envelope (3), the said guard-house (1) including means for producing rotation of the said support element (37) and the said lateral envelope (3) rigidly connected thereto about a substantially vertical axis of symmetry of the said guard-house (1).

9. An armoured guard-house (30) according to claim 1, characterised by the fact that the said base (2) includes a framework for supporting the said guard-house (1) in a position raised above ground level.

10. An armoured guard-house (1,30) according to claim 1, characterised by the fact that it includes a support element (26) for a television camera (31) and a light (32) which are adjustable over a wide range, situated above the said canopy (5).

11. An armoured guard-house (1,10) according to claim 1, characterised by the fact that it includes a series of radial support arms (28) operable to support respective anti-grenade nets (29) at a predetermined distance in front of the glazed areas (4), which nets are operable to cause possible grenades discharged towards the guard-house (1) to explode before they strike the guard-house (1) itself.

* * * * *